United States Patent [19]

Penrice

[11] Patent Number: 4,897,117

[45] Date of Patent: Jan. 30, 1990

[54] HARDENED PENETRATORS

[75] Inventor: Thomas W. Penrice, Mt. Juliet, Tenn.

[73] Assignee: Teledyne Industries, Inc., Los Angeles, Calif.

[21] Appl. No.: 244,587

[22] Filed: Sep. 13, 1988

Related U.S. Application Data

[62] Division of Ser. No. 843,715, Mar. 25, 1986, abandoned.

[51] Int. Cl.[4] ..... C22C 27/04

[52] U.S. Cl. ..... 75/248; 428/547; 428/610; 419/6; 102/517; 102/518; 102/519

[58] Field of Search ..... 428/547, 610; 75/248; 419/6; 102/517, 518, 519

[56] References Cited

U.S. PATENT DOCUMENTS

| | | | |
|---|---|---|---|
| 1,095,324 | 5/1914 | Hall | 72/371 |
| 1,532,350 | 4/1925 | Shatto | 72/371 |
| 1,543,608 | 6/1925 | Leidecker | 72/371 |
| 2,216,758 | 10/1940 | Schmidt | 72/371 |
| 2,233,869 | 3/1941 | Lukacs | 72/371 |
| 2,260,779 | 10/1941 | Hoffman | 72/371 |
| 2,356,966 | 8/1944 | Bardell . | |
| 2,738,576 | 3/1956 | Frøkjaer-Jensen | 72/299 |
| 3,377,211 | 4/1968 | Schoenfeld | 148/11.5 F |
| 3,466,916 | 9/1969 | Marcovitch | 72/371 |
| 3,698,878 | 10/1972 | Hale . | |
| 3,785,038 | 1/1974 | Zapf | 419/28 |
| 3,884,730 | 5/1975 | Hehl | 148/12.4 |
| 3,888,636 | 6/1975 | Sczerzenie | 75/248 |
| 3,979,234 | 9/1976 | Northcutt, Jr. et al. | 419/28 |
| 4,044,679 | 8/1977 | Pagano et al. | 102/52 |
| 4,094,053 | 6/1978 | Weaver | 72/371 |
| 4,108,692 | 8/1978 | Quinlan | 148/12.3 |
| 4,154,050 | 5/1979 | Nation | 148/11.5 F |
| 4,303,137 | 12/1981 | Fischer | 148/12.4 |
| 4,441,237 | 4/1984 | Kim et al. | 29/1.2 |
| 4,458,599 | 7/1984 | Mullendore et al. | 102/517 |
| 4,477,295 | 10/1984 | Kohnhauser | 148/12 E |
| 4,498,395 | 2/1985 | Kock et al. . | |
| 4,553,417 | 11/1985 | Badger | 148/12 E |
| 4,561,908 | 12/1985 | Berchen | 148/12 F |
| 4,616,569 | 10/1986 | Montier et al. | 102/517 |
| 4,841,868 | 7/1989 | Jackson | 102/517 |

*Primary Examiner*—Brooks H. Hunt
*Assistant Examiner*—Ngoclan Mai
*Attorney, Agent, or Firm*—Parmelee, Miller, Welsh & Kratz

[57] ABSTRACT

Hardened penetrators (armor penetrating projectiles) of tungsten alloy can be work hardened such that they are hard at the surface, tough in the center to resist bending, and with hardness gradient such that the surface hardness is materially harder than the center or the core thereof.

6 Claims, 2 Drawing Sheets

HARDENED PENETRATORS

This is a divisional of co-pending application Ser. No. 843,715 filed on Mar. 25, 1986 is now abandoned.

FIELD OF THE INVENTION

This invention relates to a method for hardening penetrators made from high density tungsten alloys, which comprises stressing a cylinder or column of material composed of a high density tungsten alloy in torsion past its yield point by an amount corresponding to the desired increase in hardness. This invention also relates to the novel cylinder or column of material resulting from such method. The product so produced is particularly useful as an armor piercing projectile.

BACKGROUND OF THE INVENTION

High density alloys of tungsten have been found useful in military hardware as penetrators for piercing armor plate because of their high melting points, density and other physical properties. These alloys have been prepared by blending particles of tungsten with other metals, for example, nickel and iron, compacting the resulting mixture of metal particles and then sintering the compacted particle product at very high temperatures. The performance of these alloys, as penetrators, can be substantially improved by increasing their hardness, for example, by subjecting them to a swaging operation.

Among other factors, penetration performance is improved not only by increasing the hardness of the cylinder or column of these alloys but also by increasing their length to diameter ratio, which increases the kinetic energy per unit area of impact. It is well-known in the art that spin stabilized projectiles are limited for accurate flight to a length to diameter ratio up to about 4:1. It is rather easy to fabricate such a penetrator by sintering a cylindrical piece composed of tungsten alloy having a length to diameter ratio of about 5:1 and then subjecting the sintered piece to cold work to harden the same by placing it in a suitable die and then applying coaxial compressive forces at the ends thereof to obtain a work hardened penetrator having the desired length to diameter ratio of about 4:1.

The defeat of modern armor, however, requires penetrators having length to diameter ratios in ranges in excess of about 4:1, generally from about 15:1 to about 25:1, or even higher ratios are desired in an effort to maximize the above-mentioned kinetic energy per unit area of impact. Hardening such long rods or columns using coaxial compression is not satisfactory, because long columns tend to buckle under load and thus do not flow to fit the die cavity adequately. Other methods of cold working these alloys are well-known, for example, extrusion or rotary swaging, and each of these can be used for pieces having high length to diameter ratios. While each of these methods has the capability to introduce the desired amount of cold working overall, it has been found that working is not always adequately distributed throughout the cross-section thereof. Such variations can result in residual stress patterns in the worked component. If the residual stress is in the same direction as the principal loads during launch or impact, premature failure of the penetrator may occur. Conversely, if the residual stresses are in the opposite direction, performance may be enhanced.

Referring to the art, Dardell in U.S. Pat. No. 2,356,966 discloses a method of making shot comprising softening a bar by heating, cutting the bar at its softened point and pointing the adjacent ends of the cut pieces by hammering while the shot is rotated, whereby two pointed shots are formed.

Sczerzenie et al., in U.S. Pat. No. 3,888,636 are interested in preparing an armor piercing penetrator comprising about 97 weight percent tungsten, 1.5 weight percent each of nickel and iron and to the process for making it. The sintered product is slow cooled and then quenched to harden it.

Northcutt, Jr., et al., in U.S. Pat. No. 3,979,234 disclose a process for making penetrators from tungsten, nickel and iron alloy which includes sintering the compacted powders, vacuum annealing the sintered product, and then cold working to achieve a high uniform hardness. The patentees state that swaging is the preferred form of cold working and suggest that other cold working processes can be used. No other cold working processes are specified, however.

In U.S. Pat. No. 4,441,237, Kim et al. disclose penetrators made from a continuous rod of a metal matrix composite material which involves heating sections of the rod by induction heating then twisting the softened sections to form confronting nose sections of two projectiles. Different nose shapes are obtained by varying the length of the heat-softened section. The patentees state that the twisting of the softened region causes the fibers in the nose to cross, thereby forming a harder nose than the main body of the projectile due to increased volume percentage reinforcement in the nose.

Mullendore et al. in U.S. Pat. No. 4,458,599 disclose a tungsten penetrator and a process for making the same in which the sintered bar is elongated by swaging, thereby reducing the cross sectional area of the bar, machining it to the desired shape and then annealing to obtain a bar of desired hardness.

None of the above references, taken alone or in combination, teaches or suggests working a cylinder or column of tungsten alloy by torquing the rod beyond the yield point to produce a penetrator which is hard at the surface, tough in the center to resist bending, and with a hardness gradient such that the surface hardness is materially harder than the center or the core thereof.

SUMMARY OF THE INVENTION

This invention is directed to a process for preparing a penetrator composed of a high density tungsten alloy having an increased surface hardness, with a hardness gradient from the outer surface to the core, such that the surface hardness is materially harder than the center, which comprises stressing a cylinder or column of high density tungsten alloy in torsion past its yield point by an amount corresponding to the desired degree in hardness but below its ultimate stress at failure. By "cylinder or column", I mean a cylinder or column wherein the central portion thereof, throughout at least 80 percent of its length, has essentially a true cylindrical form. The starting column may be in the form of a round bar stock or it may be square or rectangular rod stock, in which case the corners would be later removed by a machining operation to yield the desired cylindrical shape.

The invention is also directed to the product resulting from such process. The product resulting from the application of torque to the cylinder or column is characterized by the fact that longitudinal structural elements therein, parallel to the central axis of the cylinder or column and parallel to each other, before the application of torque, assume a helical configuration after the application of torque thereto but still retain their parallel relationship to each other. Thus, the distance between one helix and another helix is the same along the lengths of such helices and the distance from a helix to the central axis of the cylinder or column is the same along the length of each such helix.

The novel process of cold working the cylinder or column of high density tungsten alloy herein is simple and does not require expensive presses or swaging machines and their associated tooling. Novelty herein, compared to prior cold working processes, is that a maximum amount of cold working hardening occurs in the outer layers of the column or cylinder and this progressively reduces toward the geometric center of a section parallel to the plane of torque application.

Thus, a maximum hardness occurs at the outer surface of the penetrator and since there is little loss of ductility towards the center of the penetrator, a tough core is left to help resist bending loads caused by target impact at oblique angles. This combination of hard surface and relatively tough core is considered to be advantageous to penetration.

DETAILED DESCRIPTION OF THE PREFERRED EMBODIMENTS

Figure 1:
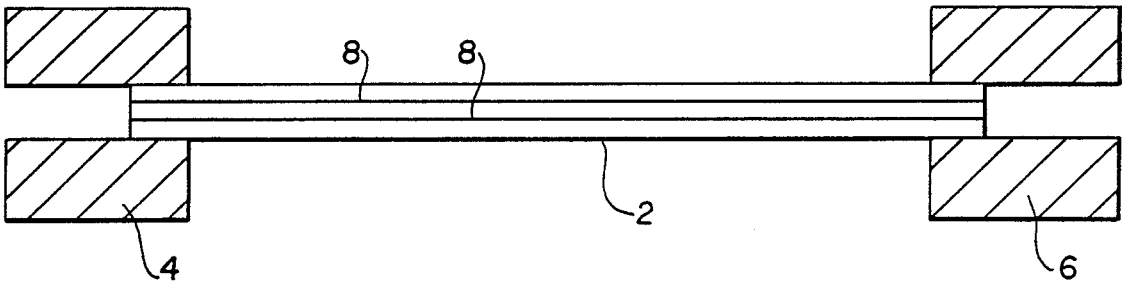
FIG. 1 is a block diagram of a device for carrying out the process herein with a tungsten cylinder or column in place prior to the application of a torque thereto.

Referring to FIG. 1, which shows in block diagram a device for carrying out the novel process defined and claimed herein, a column 2 of rectangular cross-section composed of metal matrix composite tungsten alloy, used to form a penetrator, is held in place at one end by stationary gripper 4 and at the other end by rotatable gripper 6. Preferably, without any pretreatment and at ambient temperature, rotatable gripper 6 is rotated through the required number or degrees sufficient to rotate the column in torsion past the yield point of the column 2 to obtain the desired degree of hardness on the outer surface of the column and the reduced hardness gradient to the core thereof. If desired, column 2 can be heated, for example, within the range of about 400° C. to about 500° C., prior to treatment herein, to facilitate torsion thereof. Such heating can be accomplished, for example, by passing a current through the column or the column can be preheated in a furnace. The torque is applied to the column by the rotatable gripper 6 substantially uniformly along the length thereof between grippers 4 and 6 and does not result in any appreciable diminution of the diameter of the column. The resultant column, after torque has been applied thereto, is illustrated in FIG. 2.

Figure 2:
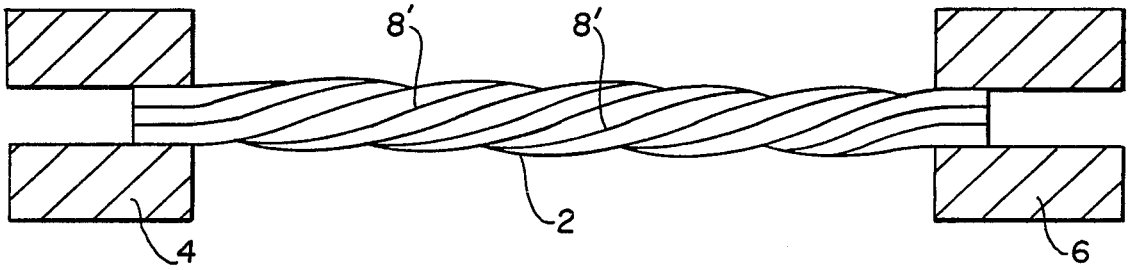
FIG. 2 is similar to FIG. 1 but illustrates a cylinder or column after the application of torque thereto in accordance with the process herein.

Longitudinal structural elements or corners 8 on the surface of the rectangular column 2 in FIG. 1, after torsion, move from an axial orientation to that of helices 8' between grippers 4 and 6, as shown in FIG. 2. The distance from a helix to the center of the column remains the same along the length of the portion of the column that has been subjected to torsion. Similarly, the distance of one helix to another helix of the column remains essentially the same along the length of the column that has been subjected to torsion. Thus, each such helix is parallel to another such helix in the cylinder. What has been said above with respect to surface longitudinal structural elements 8 is equally applicable to longitudinal structural elements in the bulk of cylinder 2. By "longitudinal structural element", therefore, I mean any axial element in the original column that is parallel to the axis of said column. The increased hardness herein results primarily from movement of a plane at right angles to the longitudinal axis of the column in shear with respect to adjacent planes thereto, the amount of such shear strain being at a maximum at the surface and decreasing to zero at the center. As a result of the torsion, herein, these planes remain parallel to each other after torsion has been applied to the column.

The penetrators herein will be composed of a tungsten alloy containing tungsten, at least one metal selected from the group consisting of iron, nickel and cobalt and, optionally, minor amounts of molybdenum, to improve ductility of the alloy, and manganese, which serves as a scavenger for oxygen and sulphur impurities for example. The amount of each component that can be present is defined below in Table I.

TABLE I

| | Preferred Broad Range (Wt. %) | Preferred Narrow Range (Wt. %) |
|---|---|---|
| Tungsten | 88–98% | 90–97% |
| Iron | 0.6–4% | 0.9–3% |
| Nickel | 1.4–9.6% | 2–7% |
| Cobalt | 0–1% | 0–0.5% |
| Molybdenum | 0–0.5% | 0–0.05% |
| Manganese | 0–0.5% | 0–0.05% |

The cylinder or column 2 of tungsten alloy subjected to torsion herein can be manufactured using any conventional powder metallurgical process. Thus, the metals used, substantially pure, and capable of passing through a 100 mesh screen, having an average diameter of about 1 to about 15 microns, preferably about 2 to about 5 microns, are blended, compacted at a pressure of about 10,000 to about 40,000 psia (pounds per square inch, absolute), generally about 25,000 to about 35,000 psia, to obtain the cylinder or column of desired dimensions and an average pressed density of about 7 to about 9 grams per cubic centimeter. The cylinder or column thus formed is then fired, one or more times, preferably in a reducing atmosphere (hydrogen or dissociated ammonia), at temperatures ranging from about 1400° to about 1600° C. for about one hour to about 5 hours. After the cylinders or columns have been fired, they are permitted to cool to ambient temperature. The cylinders or columns can then be subjected immediately to torsion, as defined herein, or at any future time.

The cylinders or columns subjected to torsion herein will generally have a length to diameter ratio above about 4:1, but more particularly in the range of about 15:1 to about 25:1. By "diameter", I mean the diameter of the inscribed circle that will touch the faces on a cross-section of the component subjected to torsion.

The amount of torsion that the cylinder or column 2 will be subjected to herein, substantially uniformly across its entire length, that is, between the grippers 4 and 6, will be at least the amount sufficient to stress it beyond its yield point by an amount corresponding to the desired degree of hardness but below its ultimate stress point at failure. Thus, good results will be obtained when the rotatable grippers holding the cylinder or rod are rotated through a twist of at least about 90°, but better results will be obtained when the same have been rotated between about 360° and about 900° of twist. It has been found that the twisted column will reverse upon itself approximately 5°–15° after the grippers are released, therefore, if for example, a finished, permanent twist of 720° is desired, column 2 should be rotated about 725°, or more, to account for this.

Figure 3:
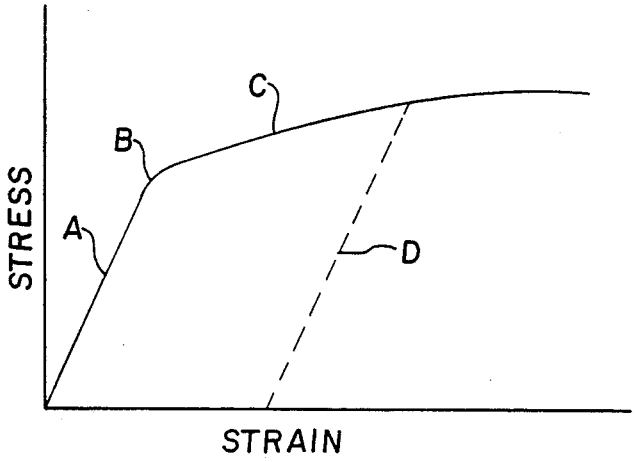
FIG. 3 illustrates the nature of the stress-strain relationship for the high density tungsten alloys used herein.

Referring to FIG. 3, the nature of the stress-strain relationship for the tungsten-nickel-iron alloys used herein is illustrated. In the range along line A, the deformation in the material being stressed is elastic and reversible. When the applied stress reaches point B, however, the material begins to yield and increasingly acquires permanent deformation as the stress level increases throughout the plastic range along line C until the material fractures. If the load stress is removed before the material fails, then the stress strain relationship follows that shown along line D. Reapplication of load causes the stress-strain plot to reverse along the line D and then continue in the general direction identified by line C until the strain reaches the ultimate stress of the material, at which point failure occurs. It is well-known in the art of metallurgy that material which has been worked into the plastic range C, exhibits increased strength and higher hardness than is found in material not subjected to deformation beyond the yield point B.

Figure 4:
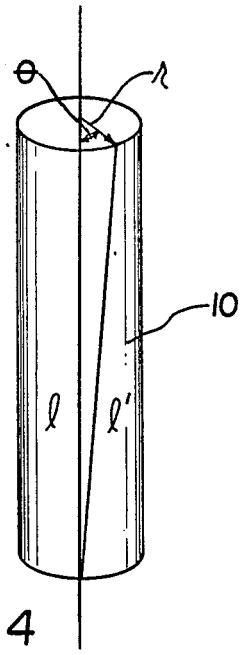
FIG. 4 schematically represents the effect of stressing a cylinder or column, circular in cross-section, of material composed of a tungsten alloy in torsion past its yield point in accordance with the invention defined herein.

FIG. 4 is a schematic representation of the effect of stressing a cylinder of material 10 in torsion past its yield point in accordance with the invention defined herein. In the drawing, l represents the length of the cylinder, or the length of a longitudinal structural surface element thereof, r the radius of the cylinder, $\phi$ the angle of twist resulting in torsion of the material 10 past its yield point and l′ the new length of longitudinal surface element after torsion. Any longitudinal structural surface element that was originally of length l becomes l′, which may be described as:

$$l'\sqrt{l^2+\left(\frac{\phi}{360}\times 2\pi r\right)^2}=\sqrt{l^2+(0.0174\phi r)^2}$$

when twisted to have a permanent offset or angular displacement of $\phi$°. The strain in the element is therefore:

$$\sqrt{L^2+(0.0174\phi r)^2}-l$$

and it is noted that the value of this function increase values of $\phi$ and r increase. Thus, the longitudinal structural elements below the surface are strained to a lesser extent than those at the surface, and eventually as the radius decreases, the strain will be below the yield point so that most of the central elements are deformed only in the elastic range. Similarly, as the value of $\phi$ decreases while approaching the fixed end of the material held between grippers 4 and 6, the strain on the material will be progressively reduced and will fall below the yield point. In general, the outer layers having been strained beyond their yield point exert a compressive stress on the central elements therein that are only elastically deformed Thus, the resultant cylinder will have an increased surface hardness, with a hardness gradient from the outer surface to the core, such that the surface hardness is materially harder than the center.

EXAMPLE I

A bar composed of high density tungsten alloy containing 93 weight percent tungsten, 4.9 weight percent nickel and 2.1 weight percent iron, having a length of 3.031 inches and a square cross-section of 0.15 inch by 0.15 inch (length to diameter ratio 22:1) was twisted, using the means shown in FIG. 1, through an angular displacement of about 725°. When the torque was released, a permanent "twist", or angular displacement of 720° was found, as measured between the end pieces of the bar between the grippers 4 and 6. The twisted bar was found to have a length of 3.022 inches, 0.009 inch less than the original length. This is a demonstration that the stretching of the outer layers of the bar has resulted in some compression of the central core of the bar. It was also noted that the original diagonal dimension of 0.212 inch was reduced to 0.204, as a result of the torque applied to the bar, which is in correspondence with the elongation of the axial elements in proximity to the surface. The bar after twisting appears to have a circular cross-section when viewed from either end caused by the fact that the outer helical elements fall as lines on a cylindrical form. That feature is extremely attractive herein. Bars having a square or rectangular cross-section are easier to manufacture than corresponding bars having a circular cross-section. For purposes of twisting a bar using the grippers of FIGS. 1 and 2, it is obvious that twisting a bar having a rectangular or square cross-section, would be far easier to grip than a similar bar having other cross-sectional configurations, for example, one having a circular cross-section. But because twisting of the bar having a square cross-section results in a bar whose outer elements follow a cylindrical form, the component can very easily be shaped to a true cylindrical form by a process of centerless grinding whereas in the untwisted form, such an operation is very difficult caused by difficulty in achieving rotation of a square section between the grinding and the follower wheels of the grinder. The portions of the bar 2 that remained within the confines of grippers 4 and 6 during torsion will remain substantially unaffected by the process herein. If desired, any one or both, of these portions can be removed from bar 2 by cutting.

EXAMPLE II

Figure 5:
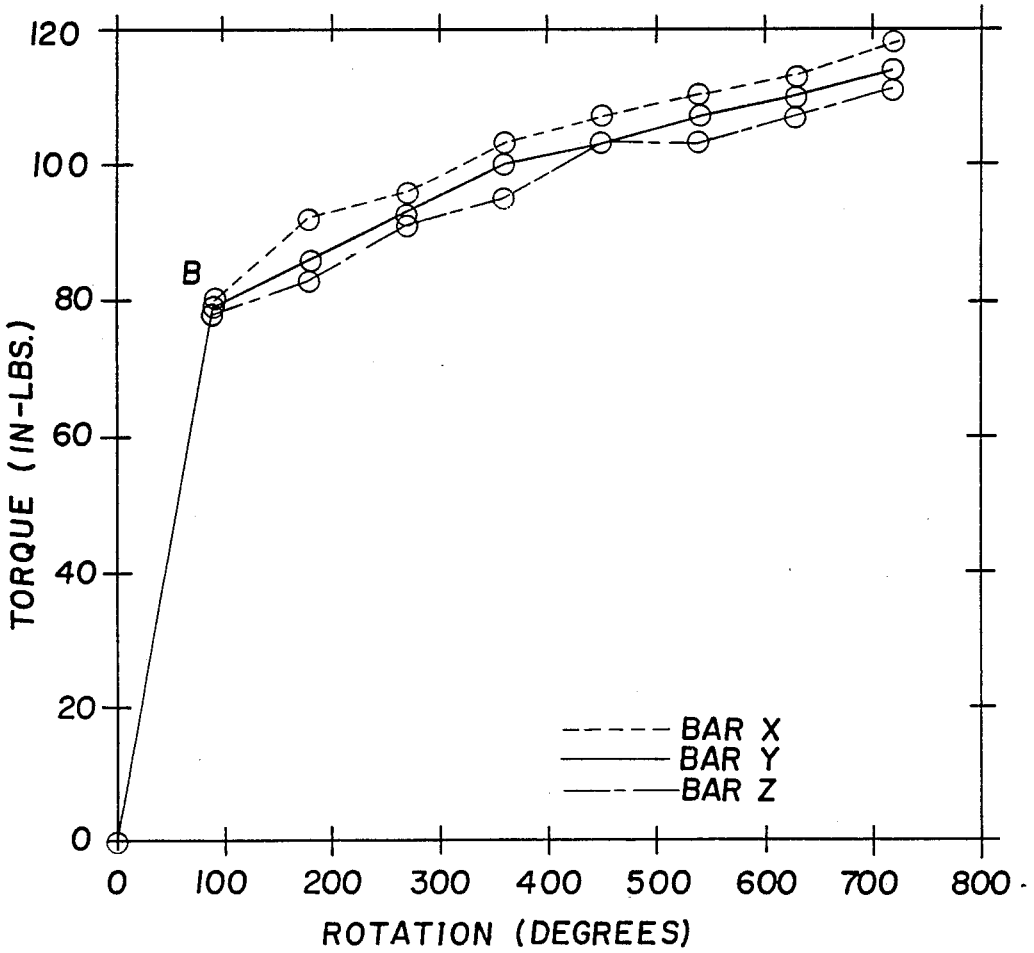
FIG. 5 is a graphical representation of the test results obtained by subjecting three separate bars composed of a tungsten alloy to torsion.

Example I was repeated, except that three bars of the same composition and of the same length, but having different cross-sections, were subjected to torsion. One bar (x) had a cross-section of 0.147 inch x 0.150 inch, a second (y) had a cross section of 0.145 inch x 0.141 inch, and a third (z) had a cross-section of 0.148 inch x 0.142 inch. The torque was applied in incremental steps of 90°. The data obtained are set forth in FIG. 5. It can be seen from FIG. 5, that the yield point B, that is, the point at which the bars achieve a permanent deformation, is obtained when each of the above bars has been rotated through an angular displacement of about 90°.

Further angular displacement of the bars results in further deformation thereof and consequently, a corresponding hardness in the bar that is a maximum on the outer layer thereof and progressively is reduced toward the geometric center of a section parallel to the plane of torque application.

The work pattern achieved in the process defined herein, which results in maximum surface hardness over a tough core, which is retained in compression, is particularly well suited to improve the performance envelope of kinetic energy penetrators when considering a range of targets.

I claim:

1. A column of material having a length to diameter above about 4:1 composed of a high density tungsten alloy having a hardness gradient from the outer surface to the core such that the surface hardness is harder than the core.

2. The column of material defined in claim 1 wherein the length to diameter is in the range of about 15:1 to about 25:1.

3. The column of material defined in claim 1 wherein the tungsten alloy consists essentially of the following composition:

| | Weight Percent |
|---|---|
| Tungsten | about 80–98 |
| Nickel | about 1.4–9.6 |
| Iron | about 0.6–4 |
| Cobalt | about 0–1 |
| Molybdenum | about 0–0.5 |
| Manganese | about 0–0.5 |
| | (Broad range) |

4. The column of material defined in claim 1 wherein the tungsten alloy consists essentially of the following composition:

| | Weight Percent |
|---|---|
| Tungsten | about 90–97 |
| Nickel | about 2–7 |
| Iron | about 0.9–3 |
| Cobalt | about 0–0.5 |
| Molybdenum | about 0–0.05 |
| Manganese | about 0–0.05 |

5. The column of material as defined in claim 1 wherein the surface of the column has structural elements thereon which are helical in configuration between the ends thereof, with the distance between one helix and another helix being the same along the lengths of such helices and the distance from a helix to the central axis of said column being the same along the length of such helix.

6. The column of material as defined in claim 5 wherein the helices have a twist configuration of between about 90° and 900°.

* * * * *